US010510288B2

(12) United States Patent
Chin et al.

(10) Patent No.: US 10,510,288 B2
(45) Date of Patent: Dec. 17, 2019

(54) DOT CORRECTION METHOD AND SYSTEM FOR LED DISPLAY DEVICE

(71) Applicant: SILICON TOUCH TECHNOLOGY INC., Hsinchu (TW)

(72) Inventors: Chi-Yuan Chin, Hsinchu (TW); Kuei-Jyun Chen, Hsinchu (TW)

(73) Assignee: SILICON TOUCH TECHNOLOGY INC., Hsinchu (TW)

( * ) Notice: Subject to any disclaimer, the term of this patent is extended or adjusted under 35 U.S.C. 154(b) by 0 days.

(21) Appl. No.: 16/451,687

(22) Filed: Jun. 25, 2019

(65) Prior Publication Data

US 2019/0318686 A1 Oct. 17, 2019

Related U.S. Application Data

(63) Continuation-in-part of application No. 15/130,283, filed on Apr. 15, 2016.

(30) Foreign Application Priority Data

Jul. 3, 2015 (TW) ..... 104121655 A

(51) Int. Cl.
*G09G 3/30* (2006.01)
*G09G 3/32* (2016.01)

(52) U.S. Cl.
CPC ..... *G09G 3/32* (2013.01); *G09G 2320/0233* (2013.01); *G09G 2320/0633* (2013.01); *G09G 2360/141* (2013.01); *G09G 2360/147* (2013.01)

(58) Field of Classification Search
CPC ..... G09G 2320/0233
USPC ..... 345/76–77
See application file for complete search history.

(56) References Cited

U.S. PATENT DOCUMENTS

| | | | | |
|---|---|---|---|---|
| 7,227,519 | B1 * | 6/2007 | Kawase | G09G 3/2081 345/77 |
| 2003/0063108 | A1 * | 4/2003 | Isono | G09G 3/2011 345/690 |
| 2008/0252664 | A1 * | 10/2008 | Huang | G09G 3/3413 345/690 |
| 2009/0027313 | A1 * | 1/2009 | Miyamoto | G09G 3/3233 345/76 |

* cited by examiner

*Primary Examiner* — Roy P Rabindranath
(74) *Attorney, Agent, or Firm* — Li & Cai Intellectual Property (USA) Office

(57) ABSTRACT

The present disclosure provides a dot correction method for a LED display device. The LED display device has a plurality of LED units arranged in an array. The method comprises providing driving currents to the plurality of LED units in columns or rows of the LED display device to make the LED units emit light; obtaining non-uniform brightness information corresponding to the LED units in columns or rows of the LED display device; and adjusting the driving current provided to each LED unit according to the non-uniform brightness information, in order to make the brightness of each LED unit be the same.

18 Claims, 9 Drawing Sheets

DOT CORRECTION METHOD AND SYSTEM FOR LED DISPLAY DEVICE

CROSS-REFERENCE TO RELATED PATENT APPLICATION

This Application is a continuation-in-part of Non-provisional application Ser. No. 15/130,283 filed on Apr. 15, 2016, currently pending.

FIELD OF THE DISCLOSURE

The instant disclosure relates to a light emitting diode (LED) display; in particular, to a dot correction method and a system for an LED display device.

BACKGROUND OF THE DISCLOSURE

A conventional method for resolving non-uniform brightness of the LEDs in a LED display device is selecting LEDs having similar brightness, or utilizing correction bits to correct the brightness of each dot. The latter method is possible by increasing the control bits of the pulse width modulation (PWM) signal.

As shown in FIG. 1A, considering the situation of dividing the brightness into 256 gray levels as an example, the brightness of the driven LED can be adjusted by pulse width modulation technology. The pulse width shown in FIG. 1B represents 1/256 of full brightness. The pulse width shown in FIG. 1C represents 3/256 of full brightness. For example, the brightness of the LED display device is originally designed to have 64 gray levels, wherein 6-bits are used. But due to the non-uniform brightness of the LEDs, additional 2-bits may be used for the purpose of brightness correction.

SUMMARY OF THE DISCLOSURE

In response to the above-referenced technical inadequacies, the present disclosure provides an LED display. The LED display includes a plurality of LED units, a storage unit, and a driving circuit. The LED units are arranged in an array. The storage unit is used for storing a non-uniform brightness information obtained by a brightness detection device. The brightness detection device has at least one light sensor element to receive light generated by the LED units. The driving circuit is coupled to the plurality of LED units and the storage unit, respectively driving the plurality of LED units to make the plurality of LED units emit light. The driving circuit respectively provides a driving current to each LED unit of the plurality of LED units. Each of the driving currents includes respective amplitude according to the non-uniform brightness information of each LED unit. The amplitude of driving current for each of the LED unit is variable. The non-uniform brightness information is obtained by calculations of a brightness information generating device coupled to a brightness detection device after the brightness detection device detecting the brightness of the plurality of LED units. When the driving circuit respectively provides a driving current to each LED unit of the plurality of LED units, each LED unit generates a first brightness, the brightness information generating device compares the first brightness generated by each LED unit with at least one target brightness for obtaining the difference between the first brightness and the target brightness, and obtains the non-uniform brightness information of the LED units according to the difference between the first brightness and the target brightness.

In one aspect, the present disclosure provides a dot correction system for an LED display device. The dot correction system for an LED display device includes a brightness detection device, a brightness information generating device, and an LED display device. The brightness detection device is used for obtaining a brightness information corresponding to LED units in columns or rows of the LED display device. The brightness detection device has at least one light sensor element to receive light generated by the LED units. The brightness information generating device is coupled to the brightness detection device, used for generating a non-uniform brightness information. The LED display device includes a plurality of LED units, a storage unit, and a driving circuit. The plurality of LED units is arranged in an array. The brightness detection device detects the brightness of the plurality of LED units. The storage unit is used for coupling to the brightness information generating device, for receiving and storing the non-uniform brightness information from the brightness information generating device. The driving circuit is coupled to the plurality of LED units and the storage unit, respectively driving the plurality of LED units to make the plurality of LED units emit light. The driving circuit respectively provides at least one driving signal in one period to each LED unit of the plurality of LED units. Each of the driving signals includes respective amplitude according to the non-uniform brightness information of each LED unit. The amplitude of the at least one driving signal is variable, and the adjusted brightness values of all of the LED units detected by the brightness detection device are uniform. The at least one driving signal is a current signal. When the driving circuit respectively provides the at least one driving signal to each LED unit of the plurality of LED units, each LED unit generates a first brightness, the brightness information generating device compares the first brightness generated by each LED unit with a target brightness for obtaining the difference between the first brightness and the target brightness, and obtains the non-uniform brightness information of the LED units according to the difference between the first brightness and the target brightness.

In certain embodiments, the present disclosure provides a dot correction method for an LED display device. The dot correction method for an LED display device is used for the LED display device. The LED display device has a plurality of LED units arranged in an array. The method includes: providing driving currents to the plurality of LED units in columns or rows of the LED display device to make the LED units emit light; obtaining a non-uniform brightness information corresponding to the LED units in columns or rows of the LED display device via a brightness detection device, wherein the brightness detection device has at least one light sensor element to receive light generated by the LED units, wherein comparing a first brightness generated by each LED unit with a target brightness, for obtaining the difference between the first brightness and the target brightness, obtaining the non-uniform brightness information of the LED units according to the difference between the first brightness and the target brightness, and storing the non-uniform brightness information to a storage unit of the LED display device; and adjusting the driving current provided to each LED unit by adding or subtracting a current adjustment value of the driving current for each LED unit according to the non-uniform brightness information, each of the driving currents includes respective variable amplitude according to the non-uniform brightness information of each LED unit, and the adjusted brightness values of all of the LED units detected by the brightness detection device are uniform.

Therefore, the provided dot correction method and system for an LED display device can scan the non-uniform brightness of the LEDs of each column or each row, and store the non-uniform brightness information NH of the LEDs in each column or each row. Then, when the LED display device is starting up, the dot correction method can adjust the driving current for the LEDs in each column or each row according to the non-uniform brightness information, without using the conventional compensation bits of the control bits in the pulse width modulation signal. For achieving the correction purpose (or efficacy), the manufacturer only has to pre-store the non-uniform brightness information NH generated by testing process to the storage unit of the LED display device at the factory or before shipment. Accordingly, the dot correction circuit used in the LED display device can be simplified, and the related cost of the circuit can be reduced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1A:
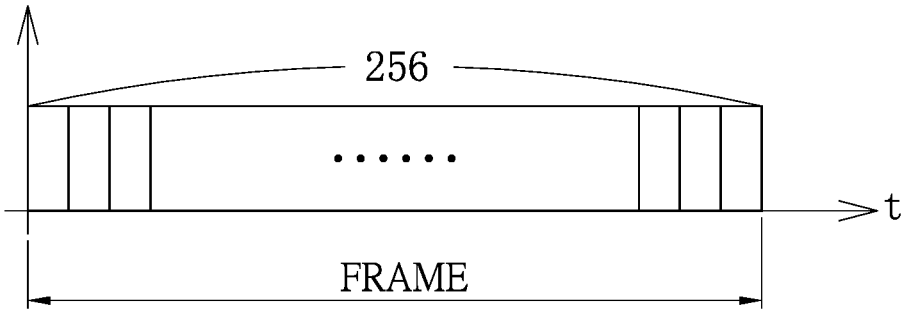
FIG. 1A shows a schematic diagram of a conventional pulse width modulation (PWM) signal used for driving an LED divided into 256 equal portions.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
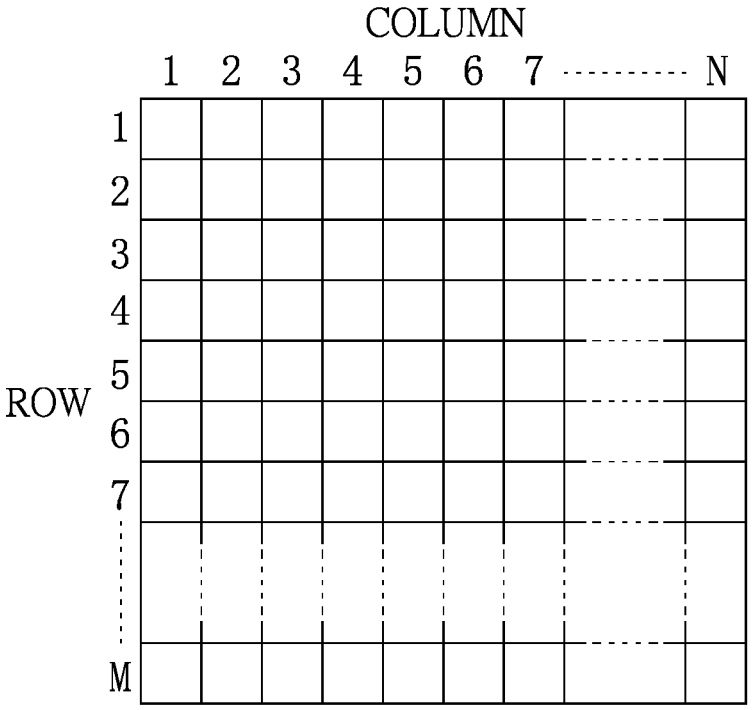
FIG. 2 shows a schematic diagram of a plurality of LED units of an LED display device arranged in an array according to an embodiment of the instant disclosure.

Please refer to FIG. 2 showing a schematic diagram of a plurality of LED units of a LED display device arranged in an array according to an embodiment of the instant disclosure. As shown in FIG. 2, the plurality of LED units is arranged in an M×N array. The array has M rows and N columns. That is, there are M LED units in each column, and there are N LED units in each row. When the same driving current is provided to each column or each row, the same pulse width modulation (PWM) display control signal may generate different brightness. For example, the same gray level signal may cause different LED units in the same column to generate different brightness. Or, the same gray level signal may cause different LED units in the same row to generate different brightness. This results from the manufacturing process and other related factors. Therefore, it may cause non-uniform brightness of each dot of the display.

Figure 3:
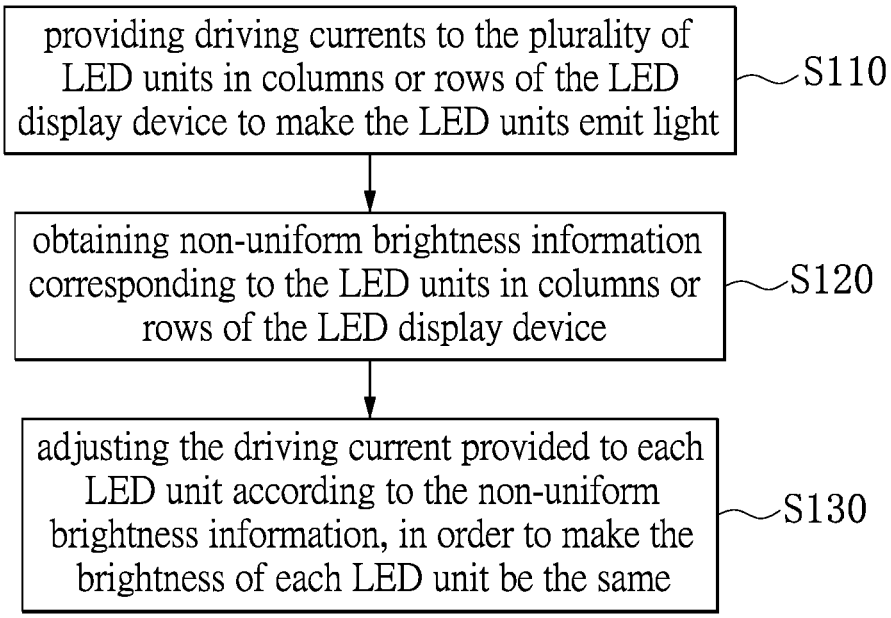
FIG. 3 shows a flow chart of a dot correction method for an LED display device according to an embodiment of the instant disclosure.

Please refer to FIG. 3 showing a flow chart of a dot correction method for an LED display device according to an embodiment of the instant disclosure. The dot correction method is used for an LED display device. The LED display device has a plurality of LED units arranged in an array (for example the array shown in FIG. 2). The method comprises the following steps. At first, in step S110, providing driving currents to the plurality of LED units in columns or rows of the LED display device to make the LED units emit light. Accordingly, each LED unit correspondingly generates a first brightness. Due to factors in the manufacturing process, the first brightness generated by each LED unit in this step may be different. Then, in step S120, obtaining a non-uniform brightness information corresponding to the LED units in columns or rows of the LED display device. Then, in step S130, adjusting the driving current provided to each LED unit according to the non-uniform brightness information, in order to make the brightness of each LED unit be the same.

Figure 4:
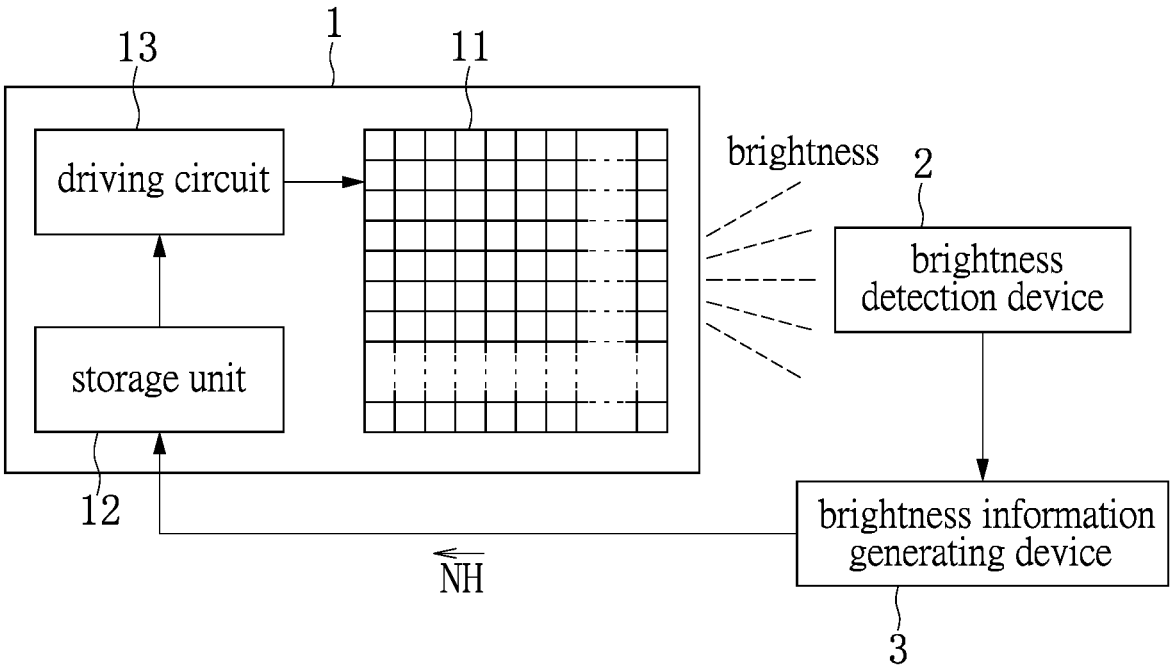
FIG. 4 shows a functional block diagram of a dot correction system for an LED display device according to an embodiment of the instant disclosure.

Please refer to FIG. 3 in conjunction with FIG. 4. FIG. 4 shows a functional block diagram of a dot correction system for an LED display device according to an embodiment of the instant disclosure. A dot correction system of an LED display device shown in FIG. 4 can be used in order to achieve the process of FIG. 3. The dot correction system for the LED display device comprises a brightness detection device 2, a brightness information generating device 3 and an LED display device 1.

The brightness information generating device 3 is coupled to the brightness detection device 2. The LED display device 1 comprises a plurality of LED units 11 arranged in an array, a storage unit 12 and a driving circuit 13. The brightness detection device 2 detects the brightness of the plurality of LED units 11 arranged in an array. The brightness detection device 2 has a light sensor element, for receiving the light generated by the LED. The detection conditions (comprising all external factors such as the detection distance or ambient light) of the brightness detection device 2 detecting each LED under test are the same. This instant disclosure does not limit the implementation manner of the brightness detection device 2. In order to detect the brightness of the LED, an artisan of ordinary skill in the art will appreciate how to implement the light sensor element and corresponding detection circuit, thus there is no need to go into details.

The brightness information generating device 3 has computing and processing power, and the brightness information generating device 3 can generate a non-uniform brightness information NH according to the detection results of the brightness detection device 2. Details of generating the non-uniform brightness information NH will be described in FIG. 5 hereinafter. The storage unit 12 is used for coupling to the brightness information generating device 3, for receiving and storing the non-uniform brightness information NH from the brightness information generating device 3. In general, when the dot correction test process is completed, the storage unit 12 can disconnect with the brightness information generating device 3. That is, the storage unit 12 can decouple with the brightness information generating device 3 when the storage unit 12 has already received and stored the non-uniform brightness information NH from the brightness information generating device 3. At the point of a finished product, the brightness detection device 2 and the brightness information generating device 3 are unnecessary for the user when the user uses the LED display device 1. Also, the storage unit 12 can pre-store the non-uniform brightness information NH in a factory setting (or before shipment). The non-uniform brightness information NH is obtained when the LED display device 1 is in the factory (or before shipment), wherein the non-uniform brightness information NH is obtained by constituting a test system comprising the LED display device 1, the brightness information generating device 3 and the brightness detection device 2 for obtaining the dot correction information (which is the non-uniform brightness information NH).

It should be noted that, in practice, when considering the LED display device 1 as a product, the LED display device 1 does not have to comprise the brightness information generating device 3 and the brightness detection device 2. However, when considering the non-uniform brightness of the LED units 11 caused by long term use, the brightness detection device 2 and the brightness information generating device 3 can be selectively integrated into the LED display device 1. Thus, the user can manually control the LED display device 1 to enable the built-in the brightness detection device 2 and the brightness information generating device 3 to update the non-uniform brightness information NH. Alternatively, based on the programming design for the firmware, the non-uniform brightness information NH can be updated each time of starting up the LED display device 1. The brightness detection device 2 and the brightness information generating device 3 can be automatically enabled to update the non-uniform brightness information NH when the LED display device 1 starts up.

The driving circuit 13 is coupled to the plurality of LED units 11 and the storage unit 12. The driving circuit 13 respectively drives the plurality of LED units 11 to make the plurality of LED units 11 emit light. The driving circuit 13 respectively provides a driving current to each LED unit of the plurality of LED units. The driving circuit 13 adjusts the driving current provided to each LED unit according to the non-uniform brightness information NH in order to make the brightness of each LED unit be the same.

In other words, the driving circuit 13 can be used to implement the step S110 of FIG. 3. The step S130 of FIG. 3 uses the brightness detection device 2 to detect the brightness of each LED unit 11 of the LED units 11 arranged in an array, and transmits the sensed brightness signal to the brightness information generating device 3 for generating the non-uniform brightness information NH. As for the step S130 of FIG. 3, after the storage unit 12 receives and stores the non-uniform brightness information NH, the storage unit 12 transmits the non-uniform brightness information NH to the driving circuit 13, then the driving circuit 13 adjusts the driving current I according to the non-uniform brightness information NH, in order to make the brightness of each LED unit be the same. In short, the non-uniform brightness information NH is used to generate a current adjustment value $\Delta I$ corresponding to the driving current of each LED unit, accordingly the driving circuit 13 can generate the adjusted driving current $(I+\Delta I)$ corresponding to each LED unit.

Figure 5:
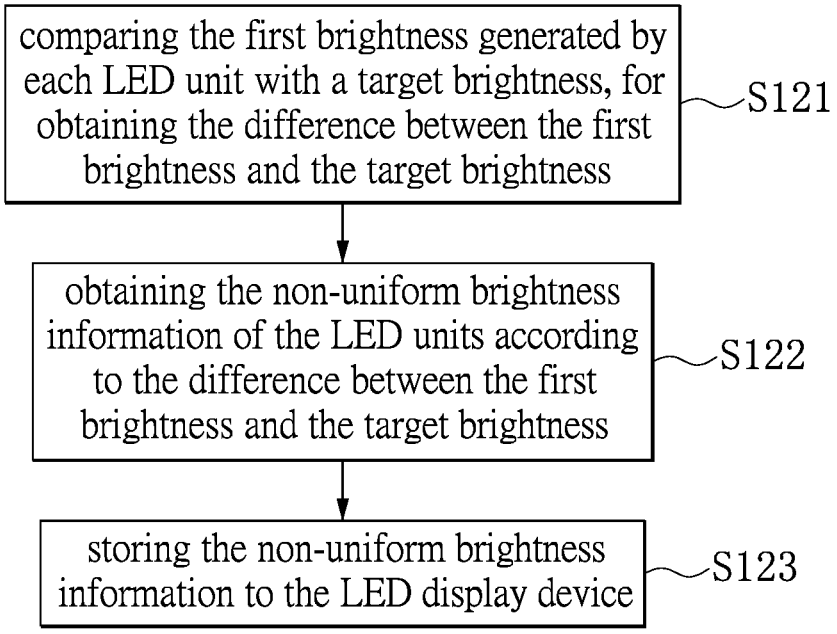
FIG. 5 shows a detailed flow chart of the step S120 in FIG. 3.

Please refer to FIG. 3 in conjunction with FIG. 4 and FIG. 5. FIG. 5 is a detailed flow chart of the step S120 in FIG. 3. In step S121, comparing the first brightness generated by each LED unit with a target brightness (or a predetermined brightness), for obtaining the difference between the first brightness and the target brightness. The step S121 can be achieved by the brightness information generating device 3. The brightness information generating device 3 can be a computer or other type of computing platform, but the instant disclosure is not so restricted. In detail, when the LED units in each column (or each row) are driven, the brightness detection device 2 respectively detects the brightness (which is the first brightness) of each LED unit in the same column (or the same row). The first brightness corresponding to each LED unit in the same column (or the same row) can be compared with preset target brightness. Accordingly, the difference between the first brightness of each LED unit in the column (or the row) and the target brightness can be obtained. Due to manufacturing process factors, each LED may generate different brightness even if driven by the same driving current. Therefore, as for the LED display device 1, it is possible to find out at least one (or more than one) LED unit providing brightness different from the brightness of other LED units. Then, in the same way, the driving circuit 13 can drive LED units in other columns (or other rows), for obtaining the difference between the first brightness of each LED unit in other columns (or other rows) and the target brightness.

Then, in step S122, obtaining the non-uniform brightness information NH of the LED units according to the difference between the first brightness and the target brightness. The mentioned non-uniform brightness information NH comprises the difference between the first brightness of each LED unit and the target brightness.

Then, in step S123, storing the non-uniform brightness information NH to the LED display device. For example, storing the non-uniform brightness information NH to the storage unit 12 of the LED display device 1. After the step S123 is completed, executing the step S130 of FIG. 3. At the same time, if the LED display device 1 has to display the target brightness, the driving circuit 13 can adjust the driving current according to the non-uniform brightness information NH, in order to make each LED unit able to generate the same target brightness. In detail, when the first brightness of the LED unit is higher than the target brightness, the non-uniform brightness information NH correspondingly can cause the driving current of the driving circuit 13 to decrease (that is the current adjustment value ΔI is negative). Thus, the adjusted driving current (I+ΔI) would be less than the original driving current I. Otherwise, when the first brightness of the LED unit is lower than the target brightness, the non-uniform brightness information NH correspondingly can cause the driving current of the driving circuit 13 to increase (that is the current adjustment value ΔI is positive). Thus, the adjusted driving current (I+ΔI) would be larger than the original driving current I. Accordingly, in the condition of the driving circuit 13 using the adjusted driving current (I+ΔI) to drive the corresponding LED unit, the brightness detection device 2 should detect that the brightness of all LED units are the same. Accordingly, it can be observed the dot correction for the LED display device 1 has been achieved.

Second Embodiment

Figure 6:
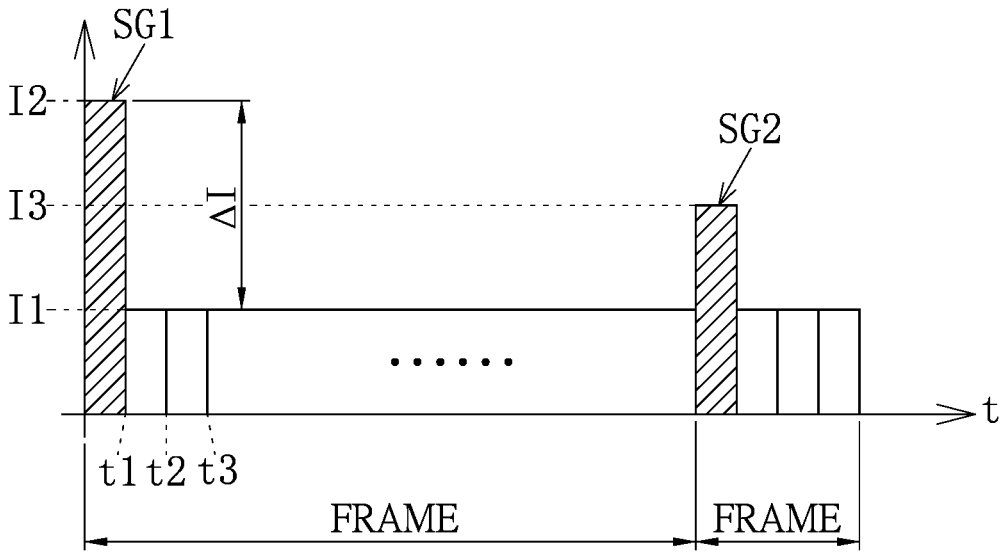
FIG. 6 is a schematic diagram of a driving signal of non-PWM signal of the instant disclosure.
Figure 7:
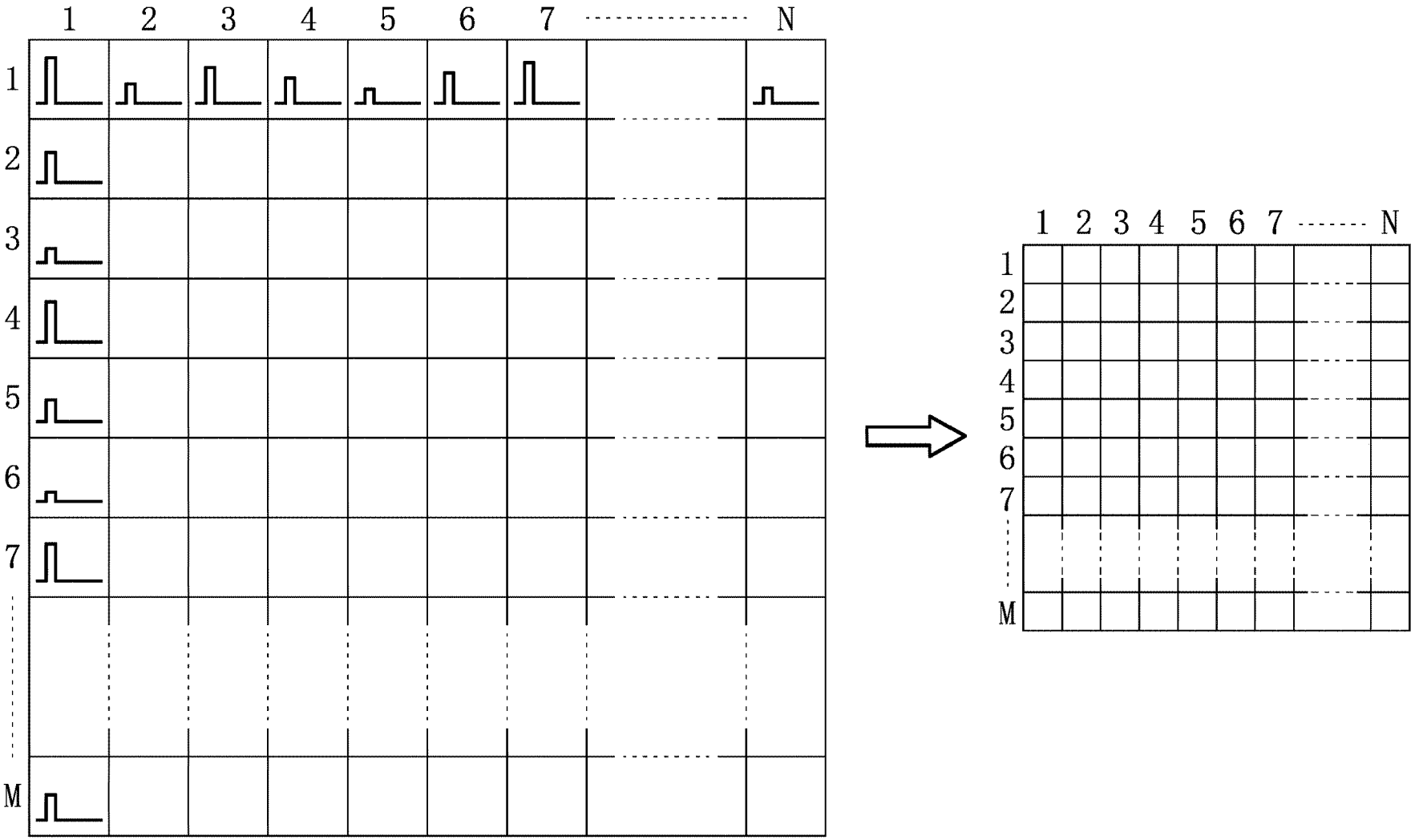
FIG. 7 is a schematic diagram of non-PWM driving signals of FIG. 6 for the LED display device according to an embodiment of the instant disclosure.

Referring to FIG. 6 and FIG. 7, FIG. 6 is a schematic diagram of a driving signal of non-PWM signal of the instant disclosure. FIG. 7 is a schematic diagram of non-PWM driving signals of FIG. 6 for the LED display device according to an embodiment of the instant disclosure.

Figure 1B:
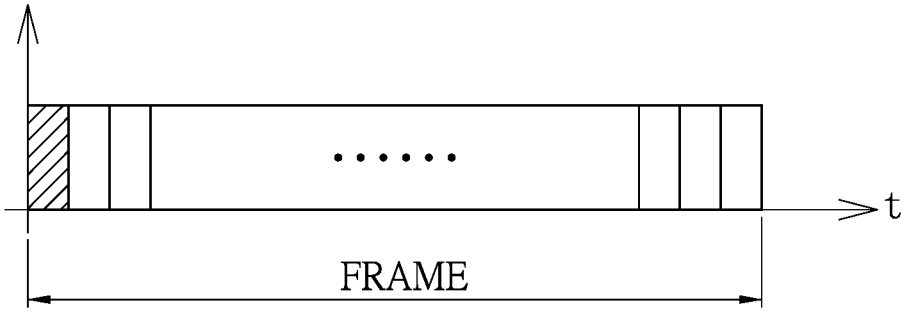
FIG. 1B shows a schematic diagram of a conventional PWM signal for an LED generating light with 1/256 of full brightness.
Figure 1C:
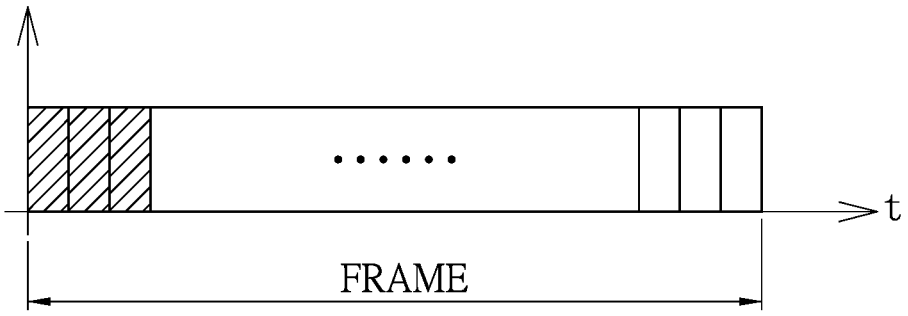
FIG. 1C shows a schematic diagram of a conventional PWM signal for an LED generating light with 3/256 of full brightness.

In general, the PWM signal has the same voltage or the same current in the duty cycle as shown in FIG. 1B and FIG. 1C. When the PWM signal is provided for driving the LED unit, the current through the LED unit is identical during the duty cycle.

As shown in FIG. 6, a driving signal SG1 and a driving signals SG2 of the above embodiment are provided in different period FRAME for driving one LED unit to emit light with different brightness. Assuming that the driving signal is a current signal, the currents through the LED unit correspond to the driving signal SG1 and the driving SG2 are different.

If the LED display device 1 has to display the target brightness, the driving circuit 13 can adjust the driving current according to the non-uniform brightness information NH, in order to make each LED unit able to generate the same target brightness. When the first brightness of the LED unit is lower than the target brightness, the non-uniform brightness information NH correspondingly can cause the driving current of the driving circuit 13 to increase (that is the current adjustment value ΔI1 is positive). Thus, the adjusted driving current (I1+ΔI=I2) would be larger than the original driving current I. Accordingly, in the condition of the driving circuit 13 using the adjusted driving current (I1+ΔI=I2) to drive the corresponding LED unit, the brightness detection device 2 should detect that the brightness of all LED units are the same. Accordingly, it can be observed the dot correction for the LED display device 1 has been achieved.

The brightness of the LED unit can be adjusted by a variation of the driving signal (driving current or driving voltage) in a predetermined time interval. As shown in FIG. 7, each of LED units receives respective driving signal for emit uniform brightness. In the embodiment, the brightness of LED unit can be adjusted by the current flowing through the LED unit (amplitude of the driving signal) according to the non-uniform brightness information NH. In the embodiment, the amplitude of the driving signal SG1 (driving current or the driving voltage) can be divided in 256 gray level to drive the LED unit. In other words, the number of the gray level can be determined based on the amplitude of the driving signal (driving current or the driving voltage).

Third Embodiment

Figure 8:
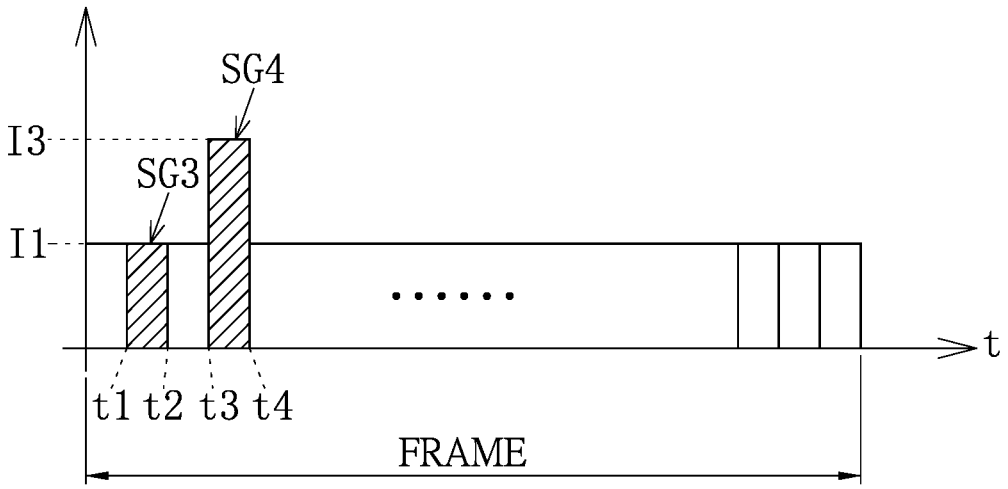
FIG. 8 is another schematic diagram of a driving signal of non-PWM signal of the instant disclosure.
Figure 9:
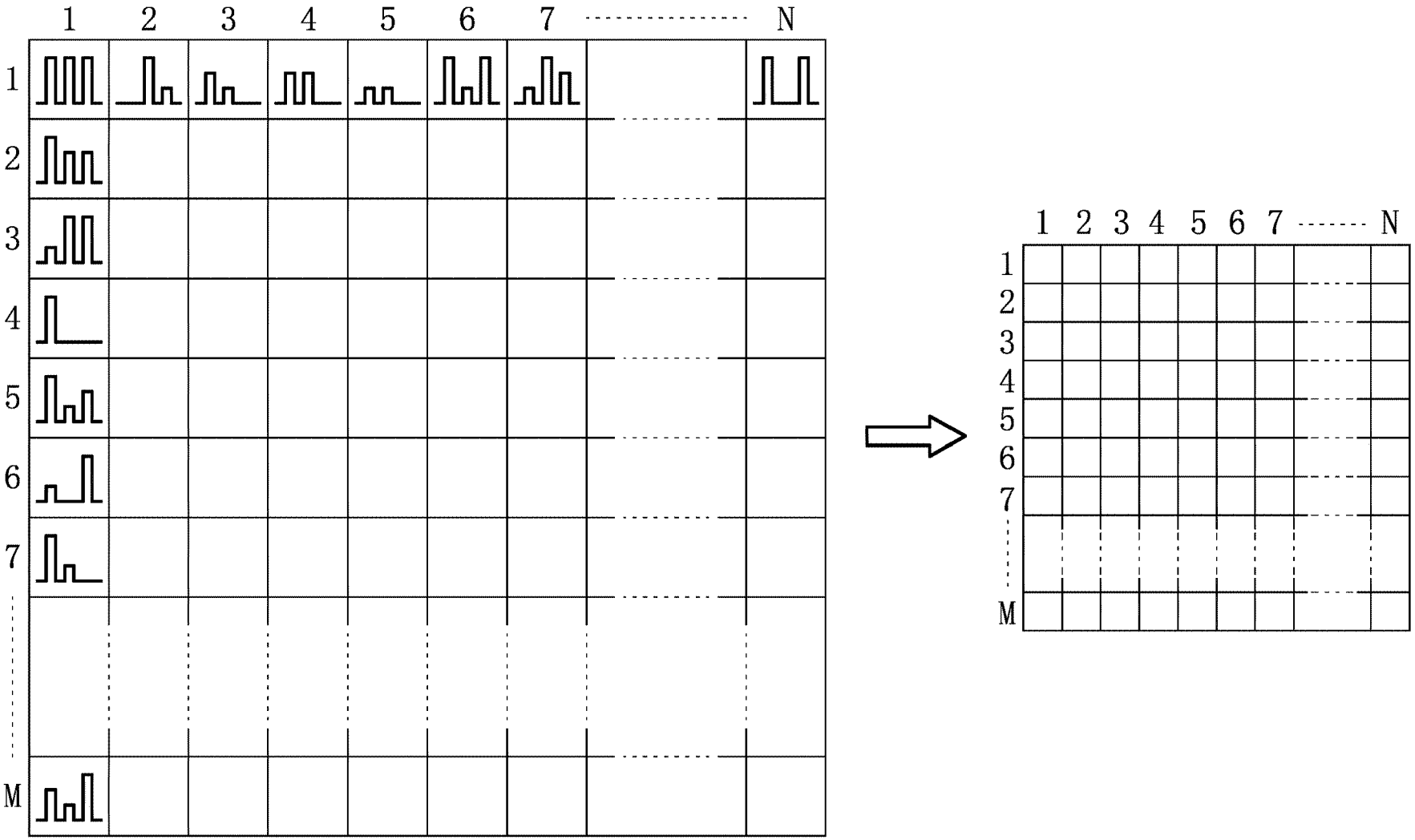
FIG. 9 is a schematic diagram of non-PWM driving signals of FIG. 8 for the LED display device according to an embodiment of the instant disclosure.

Referring to FIG. 8 and FIG. 9, FIG. 8 is another schematic diagram of a driving signal of non-PWM signal of the instant disclosure. FIG. 9 is a schematic diagram of non-PWM driving signals of FIG. 8 for the LED display device according to an embodiment of the instant disclosure.

In the embodiment, each period FRAME includes a plurality of time intervals. A driving signal SG3 is defined between t1 and t2, and a driving signal SG4 is defined in the second time interval and the fourth time interval for driving the LED unit. An amplitude I1 of the driving signals SG3 is different from an amplitude I3 of the driving SG4. In the embodiment, the brightness of LED unit can be determined by the current through the LED unit between t1 and t2, the current through the LED unit between t3 and t4, and total period FRAME. Therefore, the brightness of each of the LED units can be adjusted by a set of driving signals that the amplitudes are variable as shown in FIG. 9. The set of the driving signals (driving voltage or driving current) is determined according to the amplitudes of the driving signals, an arrangement of the driving signals in the period FRAME. The current variation of the driving current for each of the LED units is determined according to the non-uniform brightness information NH, and the current variation of the driving current is added to or subtracted from the original current.

In the embodiment, the amplitudes of the driving signal SG3 and the driving signals SG4 (driving current or the driving voltage) can be divided in 256 gray level to drive the LED unit. In other words, the number of the gray level can be determined based on a summation of the amplitude of the driving signal SG3 and the driving signal SG4 (driving current or the driving voltage). In other embodiment, a number of the driving signals in each total period FRAME. Each of the driver of the driving circuit 13 can provide several driving signals in one period FRAME to the LED units for making the LED units emitting the uniform brightness. The amplitudes of the several driving signals are variable based on the non-uniform brightness information NH.

In the embodiment, the driving signals with variable amplitudes of the LED units are used for emitting the uniform brightness. In other embodiment, the driving signals with variable amplitudes can be used for driving the LED units with different brightness or dimming the LED units.

In the embodiment, there are a first target brightness value and a plurality of second target brightness values. The first target brightness value is used for a reference for brightness correction of the LED units to achieve a uniform brightness. The second target brightness value is used for dimming each of the LED units.

In addition, the driving circuit 13 of the present disclosure includes a plurality of driver (not shown) for respectively providing driving current with variable amplitude to each row or each column of the LED units. In the embodiment, each of the drivers (not shown) of the driving circuit 13 provides a current signal with variable amplitude. In other embodiment, each of the drivers (not shown) of the driving circuit 13 can provides a voltage signal with variable amplitude, which is not limited in the present disclosure.

After brightness correction based on the first target brightness value, the brightness of each of the LED units can be dimmed by the second target brightness value, the brightness information generating device 3 compares the first brightness generated by each LED unit with each of a plurality of second target brightness for obtaining the difference between the first brightness and the plurality of second target brightness. The brightness of the LED units are dimmed by the difference between the first brightness and the plurality of second target brightness.

In conclusion, the provided dot correction method and system for an LED display device can scan the non-uniform brightness of the LEDs of each column or each row, and store the non-uniform brightness information NH of the LEDs in each column or each row. Then, when the LED display device is starting up, the dot correction method can adjust the driving current for the LEDs in each column or each row according to the non-uniform brightness information, without using the conventional compensation bits of the control bits in the pulse width modulation signal. For achieving the correction purpose (or efficacy), the manufacturer only has to pre-store the non-uniform brightness information NH generated by testing process to the storage unit of the LED display device at the factory or before shipment. Accordingly, the dot correction circuit used in the LED display device can be simplified, and the related cost of the circuit can be reduced.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An LED display, comprising:

a plurality of LED units arranged in an array;

a storage unit, used for storing a non-uniform brightness information obtained by a brightness detection device, wherein the brightness detection device has at least one light sensor element to receive light generated by the LED units; and a driving circuit, coupled to the plurality of LED units and the storage unit, respectively driving the plurality of LED units to make the plurality of LED units emit light, wherein the driving circuit respectively provides a driving current to each LED unit of the plurality of LED units, each of the driving currents includes respective amplitude according to the non-uniform brightness information of each LED unit, the amplitudes of driving current for each of the LED unit is variable;

wherein the non-uniform brightness information is obtained by calculations of a brightness information generating device coupled to the brightness detection device after the brightness detection device detecting the brightness of the plurality of LED units;

wherein when the driving circuit respectively provides a driving current to each LED unit of the plurality of LED units, each LED unit generates a first brightness, the brightness information generating device compares the first brightness generated by each LED unit with at least one target brightness for obtaining the difference between the first brightness and the target brightness, and obtains the non-uniform brightness information of the LED units according to the difference between the first brightness and the target brightness.

2. The LED display of claim 1, wherein the brightness information generating device compares the first brightness generated by each LED unit with a first target brightness for obtaining the difference between the first brightness and the target brightness, and the adjusted brightness values of all of the LED units detected by the brightness detection device are uniform.

3. The LED display of claim 2, wherein the brightness information generating device compares the first brightness generated by each LED unit with each of a plurality of second target brightness for obtaining the difference between the first brightness and the plurality of second target brightness, the brightness of the LED units are dimmed by the difference between the first brightness and the plurality of second target brightness.

4. The LED display of claim 1, wherein the driving circuit includes a plurality of drivers, the drivers respectively provides the driving current to each LED unit of the plurality of LED units.

5. The LED display of claim 1, wherein the non-uniform brightness information of each LED unit is determined based on a manufacturing process thereof.

6. The dot correction system for an LED display device of claim 5, wherein the at least one driving signal includes one driving signal in one period, an amplitude of the driving signal in one period provided to each LED unit is variable and determined based on the non-uniform brightness information of each LED unit.

7. A dot correction system for an LED display device, comprising:

a brightness detection device used for obtaining a brightness information corresponding to LED units in columns or rows of the LED display device, wherein the brightness detection device has at least one light sensor element to receive light generated by the LED units;

a brightness information generating device, coupled to the brightness detection device, used for generating a non-uniform brightness information; and an LED display device, comprising:

a plurality of LED units arranged in an array, wherein the brightness detection device detects the brightness of the plurality of LED units;

a storage unit, used for coupling to the brightness information generating device, for receiving and storing the non-uniform brightness information from the brightness information generating device; and a driving circuit, coupled to the plurality of LED units and the storage unit, respectively driving the plurality of LED units to make the plurality of LED units emit light, wherein the driving circuit respectively provides at least one driving signal in one period to each LED unit of the plurality of LED units, each of the driving signals including respective amplitudes according to the non-uniform brightness information of each LED unit, the amplitude of the at least one driving signal is variable, and the adjusted brightness values of all of the LED units detected by the brightness detection device are uniform, the at least one driving signal is a current signal;

wherein when the driving circuit respectively provides the at least one driving signal to each LED unit of the plurality of LED units, each LED unit generates a first brightness, the brightness information generating device compares the first brightness generated by each LED unit with a target brightness for obtaining the difference between the first brightness and the target brightness, and obtains the non-uniform brightness information of the LED units according to the difference between the first brightness and the target brightness.

8. The dot correction system for an LED display device of claim 7, wherein the at least one driving signal includes a plurality of driving signals in one period, amplitudes of the plurality of driving signals in one period are variable and determined based on the non-uniform brightness information of each LED unit.

9. The dot correction system for an LED display device of claim 7, wherein the driving circuit includes a plurality of drivers, the drivers respectively provides the driving signal to each LED unit of the plurality of LED units.

10. The dot correction system for an LED display device of claim 7, wherein the non-uniform brightness information of each LED unit is determined based on a manufacturing process thereof.

11. A dot correction method for an LED display device, used for the LED display device, the LED display device having a plurality of LED units arranged in an array, the method comprising:

providing driving currents to the plurality of LED units in columns or rows of the LED display device to make the LED units emit light;

obtaining a non-uniform brightness information corresponding to the LED units in columns or rows of the LED display device via a brightness detection device, wherein the brightness detection device has at least one light sensor element to receive light generated by the LED units, wherein comparing a first brightness generated by each LED unit with a target brightness, for obtaining the difference between the first brightness and the target brightness, obtaining the non-uniform brightness information of the LED units according to the difference between the first brightness and the target brightness, and storing the non-uniform brightness information to a storage unit of the LED display device; and adjusting the driving current provided to each LED unit by adding or subtracting a current adjustment value of the driving current for each LED unit according to the non-uniform brightness information, each of the driving currents includes respective variable amplitudes according to the non-uniform brightness information of each LED unit, and the adjusted brightness values of all of the LED units detected by the brightness detection device are uniform.

12. The dot correction method for the LED display device of claim 11, wherein in the step of adjusting the driving current provided to each LED unit according to the non-uniform brightness information in order to make the brightness of each LED unit be the same, the non-uniform brightness information corresponds to the current adjustment value of the driving current for each LED unit.

13. The dot correction method for the LED display device of claim 12, wherein the first brightness is detected by a brightness detection device, the non-uniform brightness information is generated by a brightness information generating device.

14. The dot correction method for the LED display device of claim 11, wherein in the step of adjusting the driving current provided to each LED unit according to the non-uniform brightness information in order to make the brightness of each LED unit be the same, the non-uniform brightness information corresponds to the current adjustment value of the driving current for each LED unit.

15. The dot correction method for the LED display device of claim 14, wherein the first brightness is detected by a brightness detection device, the non-uniform brightness information is generated by a brightness information generating device.

16. The dot correction method for the LED display device of claim 14, wherein in the step of providing driving currents to the plurality of LED units in columns or rows, the LED display device includes a driving circuit, the driving circuit respectively provides the driving signal to each LED unit of the plurality of LED units.

17. The dot correction system for an LED display device of claim 16, wherein the driving circuit includes a plurality of drivers, the drivers respectively provides the driving signal to each LED unit of the plurality of LED units.

18. The dot correction system for an LED display device of claim 14, wherein the non-uniform brightness information of each LED unit is determined based on a manufacturing process thereof.

* * * * *